US012674602B2

(12) United States Patent
Le Mer

(10) Patent No.: US 12,674,602 B2
(45) Date of Patent: Jul. 7, 2026

(54) CONDENSATION HEAT EXCHANGER

(71) Applicant: Sermeta, Morlaix (FR)

(72) Inventor: Joseph Le Mer, Plouezoch (FR)

(73) Assignee: Sermeta, Morlaix (FR)

( * ) Notice: Subject to any disclaimer, the term of this patent is extended or adjusted under 35 U.S.C. 154(b) by 116 days.

(21) Appl. No.: 18/579,693

(22) PCT Filed: Jul. 15, 2022

(86) PCT No.: PCT/EP2022/069917
§ 371 (c)(1),
(2) Date: Jan. 16, 2024

(87) PCT Pub. No.: WO2023/285682
PCT Pub. Date: Jan. 19, 2023

(65) Prior Publication Data

US 2024/0353145 A1 Oct. 24, 2024

(30) Foreign Application Priority Data

Jul. 16, 2021 (FR) ..... 2107687

(51) Int. Cl.
*F24H 1/43* (2022.01)
*F24H 8/00* (2022.01)
(Continued)

(52) U.S. Cl.
CPC ..... *F24H 1/43* (2013.01); *F24H 8/00* (2013.01); *F24H 9/0026* (2013.01); *F28D 7/024* (2013.01)

(58) Field of Classification Search
CPC ... F24H 1/43; F24H 1/16; F24H 1/403; F24H 1/40; F24H 9/0026; F24H 8/00; F24H 9/0031; F28F 1/36; F28D 1/0472
See application file for complete search history.

(56) References Cited

U.S. PATENT DOCUMENTS 7,909,005 B2 * 3/2011 Le Mer ..... F28D 7/024 122/18.1
8,770,153 B2 7/2014 Hamada et al.
(Continued)

FOREIGN PATENT DOCUMENTS

CN 1959277 A 5/2007
CN 111417823 A 7/2020
(Continued)

OTHER PUBLICATIONS

International Search Report for PCT/EP2022/069917 mailed Oct. 7, 2022. 3 pages.
(Continued)

*Primary Examiner* — Jianying C Atkisson
*Assistant Examiner* — For K Ling
(74) *Attorney, Agent, or Firm* — Lerner David LLP

(57) ABSTRACT

The present invention relates to a condensation heat exchanger (10) comprising: —at least one tube (7) in the form of a helical winding (70), having a planar front face (71) and a planar rear face (72) and being housed in a casing (2), —means (5) for producing a hot gas inside said casing, —a discoid deflector (8) which is provided with a peripheral flange (823) and is arranged in the helical winding (70), such that the flange thereof is inserted in a gap between two successive turns, and a combustion chamber (25) and a condensation chamber (26) are to be provided in the casing (2). This exchanger is noteworthy in that the front face (8231) of said flange (823) is gas-tightly attached to the rear face (72) of the final turn (702) of said winding (70) which is located in the combustion chamber (25), in that at least one protruding element (8233) is arranged between the rear face (8232) of said flange (823) and the front face (71) of the first turn (703) which is located in the condensation chamber (26), so as to provide therebetween a gap for circulation of
(Continued)

the gases (73'), and in that the external diameter of the discoid deflector (D1) is less than the internal diameter (D2) of the helical winding (70) so as to provide a passage for circulation of the hot gases (27).

16 Claims, 10 Drawing Sheets

(51) Int. Cl.
*F24H 9/00* (2022.01)
*F28D 7/02* (2006.01)

(56) References Cited

U.S. PATENT DOCUMENTS

| | | | | |
|---|---|---|---|---|
| 11,041,659 | B2 * | 6/2021 | De Nardis | F28D 7/024 |
| 11,598,555 | B2 | 3/2023 | Alessandrini | |
| 11,644,246 | B2 * | 5/2023 | Giannoni | F24H 1/16 165/163 |
| 2006/0196450 | A1 * | 9/2006 | Le Mer | F24H 9/2035 122/18.1 |
| 2007/0099134 | A1 * | 5/2007 | Hamada | F23N 1/082 431/12 |
| 2007/0209606 | A1 * | 9/2007 | Hamada | F28F 1/02 122/18.1 |
| 2008/0185131 | A1 * | 8/2008 | Cannas | F24H 1/43 165/157 |
| 2008/0185132 | A1 * | 8/2008 | Cannas | F28F 1/16 165/163 |
| 2012/0000456 | A1 * | 1/2012 | Le Mer | F23M 7/04 126/193 |
| 2016/0265808 | A1 * | 9/2016 | Magnone | F24H 9/0026 |

FOREIGN PATENT DOCUMENTS

| | | | | |
|---|---|---|---|---|
| EP | 3141838 | A1 | 3/2017 | |
| FR | 2846075 | A1 | 4/2004 | |
| FR | 2942866 | A1 | 9/2010 | |
| JP | 2005321172 | A | 11/2005 | |
| WO | WO-9416272 | A1 * | 7/1994 | F28F 3/042 |
| WO | WO-2007066369 | A1 * | 6/2007 | F28F 9/02 |

OTHER PUBLICATIONS

Search Report (dated Mar. 17, 2026) and Office Action (issued Mar. 26, 2026) for Chinese Application No. 202280049960.X.

* cited by examiner

CONDENSATION HEAT EXCHANGER

CROSS-REFERENCE TO RELATED APPLICATIONS

The present application is a national phase entry under 35 U.S.C § 371 of International Application No. PCT/EP2022/069917 filed Jul. 15, 2022, which claims priority from French Application No. 2107687 filed Jul. 16, 2021, all of which are hereby incorporated herein by reference.

FIELD OF THE INVENTION

The invention lies in the field of condensation heat exchangers.

The present invention more specifically relates to the structure of the deflector, disposed between the combustion chamber and the condensation chamber of this exchanger, as well as the mode of fixing this deflector.

STATE OF THE ART

FIG. 1 attached represents a sectional view of an exemplary embodiment of a condensation heat exchanger, in accordance with the state of the art.

In this figure, it can be seen that the condensation heat exchanger 1 comprises a casing 2, a spirally wound tube 3, a door 4, means 5 for supplying or producing hot gases and a deflector 6.

This heat exchanger 1 extends along a longitudinal axis X-X'. In FIG. 1, it is represented in its normal position of use.

The casing 2 comprises a tubular body 20, of axis X-X', closed at its rear end by a bottom 21 and comprising a facade 22 at its front end. Conventionally, in the remainder of the description and the claims, the term "front face" designates a face turned towards the front of the exchanger, that is to say towards the facade 22 while the term "rear face" designates a face turned towards the back of the exchanger, that is to say towards the bottom 21.

The casing 2 comprises a sleeve 23 for discharging burnt gases. Furthermore, the lower part of the casing 2 is slightly sloping, so as to allow the discharge of the condensates by gravity, via an outlet orifice 24, connected to a duct for discharging 240 these condensates.

The facade 22 has at its periphery, a rim 220 which is fixed, preferably welded or crimped, in a gas-tight manner, on the front edge of the tubular body 20. The facade 22 comprises a central opening 221, able to be obturated by the door 4.

The door 4 supports in its central part, a burner 50, for example a gas or oil burner, which constitutes an exemplary embodiment of a means for producing hot gases 5. This burner 50 could be replaced by means for supplying a hot gas, produced outside the casing 2 and propelled inside it, for example using a fan.

The tube 3 is helically wound on itself, so as to form a helical winding 30, of longitudinal axis X-X'. It has two ends forming an inlet mouth and an outlet mouth, not visible in the figures.

It is made of a thermally good conductive material, in particular made of metal, advantageously stainless steel. It is intended to receive a fluid to be heated, such as water.

The tube 3 has an oval straight section (this case not being represented in the figure) or a rectangular straight section whose two longitudinal sides are flattened and whose major axis is perpendicular or approximately perpendicular to the axis X-X' of the helical winding. The tube 3 thus has a front face 31 and a rear face 32. These faces 31, 32 are planar or substantially planar depending on the section.

There is an interstice 33 of calibrated value, between two neighboring turns of the tube 3. This interstice 33 can be obtained for example using bosses 34 formed on one of the two planar faces of the tube 3, here for example the front face 31. These bosses appear better in the attached FIG. 2.

The deflector 6 is disposed inside the helical winding 30 of the tube 3, perpendicularly to the axis X-X', so as to provide inside the casing 2, on the one hand a combustion chamber 25 which extends between the door 4 and the deflector 6 and which contains the burner 50, and on the other hand a condensation chamber 26 which extends between the deflector 6 and the bottom 21 of the casing 2.

Conventionally, the first turn of the part of the helical winding of the tube 3 located in the combustion chamber 25 is the one located in contact with the facade 22 and it is referenced 35, while the last turn of this same part is referenced 36. Similarly, the last turn of the part of the helical winding of the tube 3 located in the condensation chamber 26 is the one located in contact with the bottom 21 and it is referenced 38, while the first turn of this same part is referenced 37.

The deflector 6 comprises a disk 61 made of thermally insulating material, carried by a thin sheet metal frame 62, the latter being provided with a radial peripheral flange 63.

The deflector 6 is mounted inside the winding 30 of the tube 3, so that its flange 63 is inserted and positioned in a gas-tight manner, in the interstice 33 existing between the last turn 36 of the tube 3 located in the combustion chamber 25 and the first turn 37 of the tube 3 located in the condensation chamber 26.

The operation of this heat exchanger 1 is as follows. The fluid (water) to be heated circulates in countercurrent to the hot gases. It is introduced into the last turn 38 and exits the helical winding through the first turn 35.

The hot gases, produced by the burner 50 inside the combustion chamber 25, can leave the latter only by passing through the interstices 33, from inside to outside, (arrows i). In doing so, they heat the walls of the tube 3 and therefore water circulating therein. When the hot gases come into contact with the body 20 of the casing 2, they are directed towards the condensation chamber 26 (arrows j), then they return inside the condensation chamber 26, by passing through the interstices 33, this time from outside to inside (arrows k).

As can be seen in FIG. 1, given the mode of mounting the deflector 6, there is no passage of hot gases between the last turn 36 and the flange 63 or between the first turn 37 and the flange 63.

The heat exchange between the hot gases and the water circulating in the first turn 37 and in the last turn 36 is therefore less good and the overall efficiency of the exchanger 1 is therefore lower.

Furthermore, this obturation of the passage between the two turns 36 and 37 generates a pressure loss of the hot gases circulating in the casing 2.

DISCLOSURE OF THE INVENTION

One aim of the invention is therefore to resolve the aforementioned drawbacks, and in particular to improve the heat exchange between the hot gases and the water circulating in the first turn of the tube on the condensation chamber side and in the last turn on the combustion chamber side and to increase the number of passages between the turns.

Another aim of the invention is to reduce the pressure losses of the hot gases circulating in the interstices between the turns of the tube.

For this purpose, the invention relates to a condensation heat exchanger comprising:

- at least one tube, helically wound so as to form a helical winding and inside which a fluid to be heated such as water circulates, this tube being made of a thermally good conductive material and having planar or substantially planar front face and rear face opposite to each other and perpendicular or approximately perpendicular to the axis of said helical winding, this winding being arranged so as to provide an interstice between the adjacent turns,
- a gas-tight casing inside which said at least one tube is mounted, this casing comprising a bottom and a facade on which a door is mounted, this casing being provided with a sleeve for discharging burnt gases, the front face of the tube being turned towards the facade of the casing and the rear face of the tube being turned towards the bottom of the casing,
- means for supplying and/or producing a hot gas inside said casing, such as a gas or oil burner, mounted on said door,
- a discoid deflector being disposed inside the helical winding of the tube, so as to provide inside the casing, on the one hand a combustion chamber between the door and said deflector, and on the other hand a condensation chamber between said deflector and the bottom of the casing, this deflector comprising a disk made of thermally insulating material, carried by a sheet metal frame provided with a peripheral flange, this flange being interposed in an interstice between two successive turns of said winding and the external diameter of the discoid deflector being smaller than the internal diameter of the helical winding taken at the intrados ends of its turns, so as to provide, between the edge of said discoid deflector and the intrados end of the first turn of the winding located in the condensation chamber, a passage called "hot gas circulation" passage.

According to the invention, said flange has a front face turned towards the facade of the casing and a rear face turned towards the bottom of the casing, opposite to each other, said front face being positioned in a gas-tight manner against the rear face of the last turn of the winding located in the combustion chamber, at least one spacer element is disposed between the rear face of said flange and the front face of the first turn of said winding located in the condensation chamber, so to provide therebetween an interstice called "gas circulation" interstice, so that these hot gases radially or approximately radially pass through said gas circulation interstice, from outside to inside, then axially pass through said gas circulation passage from front to back, in the direction of the condensation chamber.

Thanks to the characteristics of the invention, the hot gases can circulate between the last turn on the combustion chamber side and the first turn of the tube on the condensation chamber side. The heat exchange is thereby improved. Thus, in the exemplary embodiment represented in FIGS. 1 and 3, where there are four turns in the condensation chamber, while there were only three passages for the hot gases between these four turns in the state of the art (see FIG. 1), there are now four passages with the solution of the invention (see FIG. 3), namely an 33% increase in the passage of hot gases.

Furthermore, the fact of creating said gas circulation interstice and said hot gas circulation passage makes it possible to reduce the pressure losses of the circulating gases. Therefore, the fan (not represented in the figures) which makes it possible to propel the air/gas mixture into the burner 50 or the fan of the hot gas supply means 5, does not need to be as powerful as that of the state of the art and its electrical consumption is lower.

According to other advantageous and non-limiting characteristics of the invention, taken alone or in combination:

- the front face of the first turn of the winding located in the condensation chamber is provided with an annular shoulder which extends from the intrados end of this turn and said at least one spacer element extends between said annular shoulder and said rear face of the flange, so as to form said circulation interstice;
- the rear face of the last turn of the winding located in the combustion chamber is provided with an annular shoulder which extends from the intrados end of this turn, the front face of the flange is disposed in a gas-tight manner against this annular shoulder;
- said spacer element consists of a protruding element, such as a stamping, formed on the rear face of the flange, this protruding element bearing against the front face of the first turn of the winding located in the condensation chamber, or against the annular shoulder of this front face, so as to provide said gas circulation interstice;
- said spacer element consists of a protruding element, such as a boss formed in the wall of the tube, this protruding element protruding from the front face of the first turn of the winding located in the condensation chamber or from the annular shoulder of this front face and this protruding element is bearing against said rear face of the flange, so as to provide said gas circulation interstice;
- said spacer element consists of a comb having a tooth interposed between the front face of the first turn of the winding located in the condensation chamber and the rear face of said flange, so as to provide said gas circulation interstice;
- said sheet metal frame of the discoid deflector has a circular bottom bordered by an annular rim perpendicular to this bottom, so as to provide a discoid cavity for receiving the disk made of thermally insulating material and the peripheral flange protrudes outwards from this annular rim;
- the disk made of thermally insulating material has a protruding end which protrudes from the discoid cavity inwardly of the combustion chamber and the diameter of this protruding end is equal to the internal diameter of the helical winding of the tube, taken at the intrados ends of the turns of the tube, so that the lateral edge of this protruding end is in gas-tight contact with the intrados end of the last turn of the tube located in the combustion chamber, thus preventing the passage of hot gases between the two;
- the exchanger comprises a single tube forming the helical winding and the peripheral flange of the sheet metal frame of the deflector is helical;
- the exchanger comprises at least two tubes helically wound to form at least two adjacent helical windings, one being disposed in the combustion chamber and the other being disposed in the condensation chamber and the peripheral flange of the sheet metal frame of the deflector, disposed between said two adjacent windings, is annular and perpendicular to the axis of the two adjacent helical windings.

DESCRIPTION OF THE FIGURES

Other characteristics, aims and advantages of the invention will emerge from the following description, which is purely illustrative and not limiting, and which should be read in relation to the appended drawings in which.

DETAILED DESCRIPTION OF THE INVENTION

Figure 1:
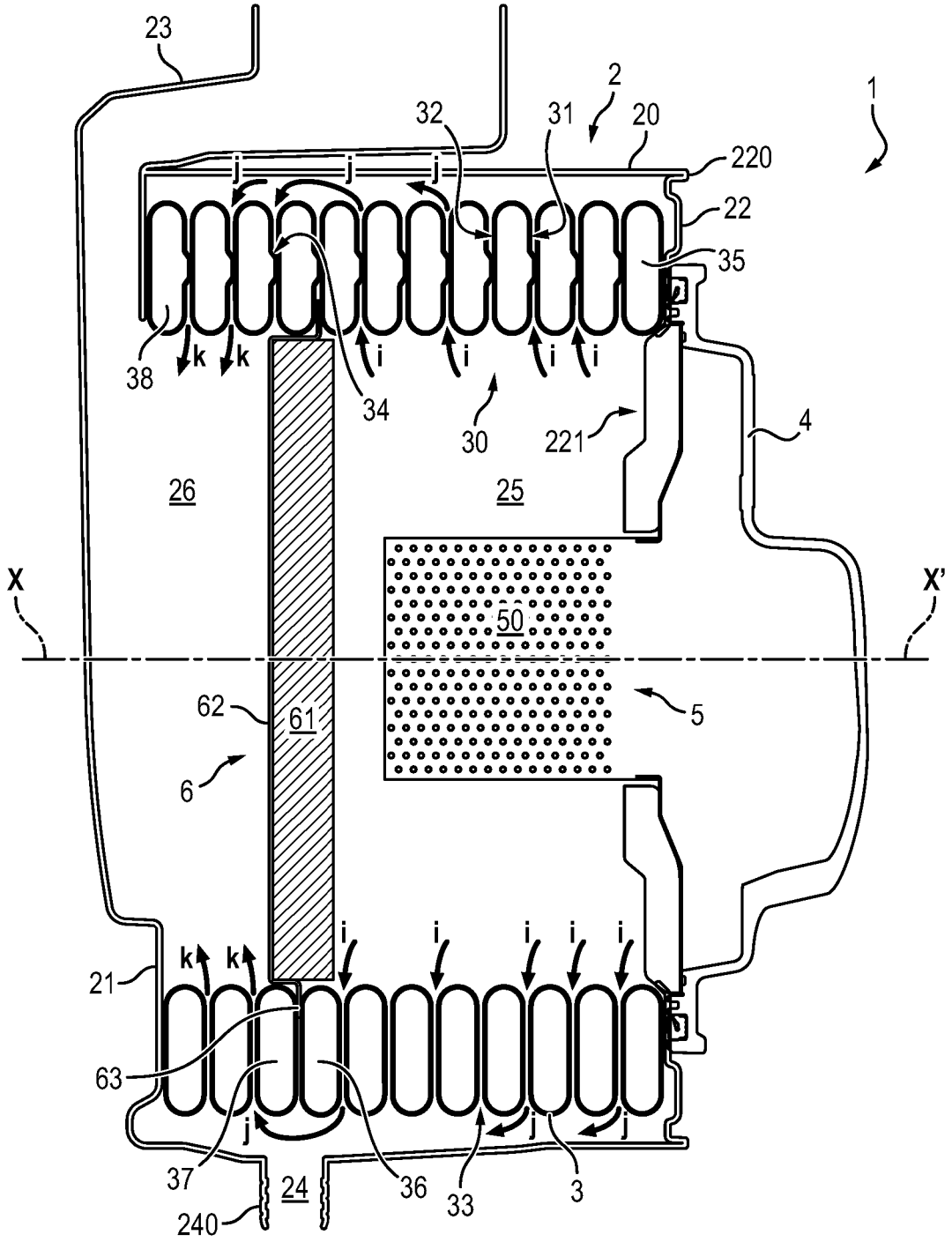
FIG. 1 is a longitudinal sectional view of an exemplary embodiment of a condensation heat exchanger, in accordance with the state of the art.
Figure 2:
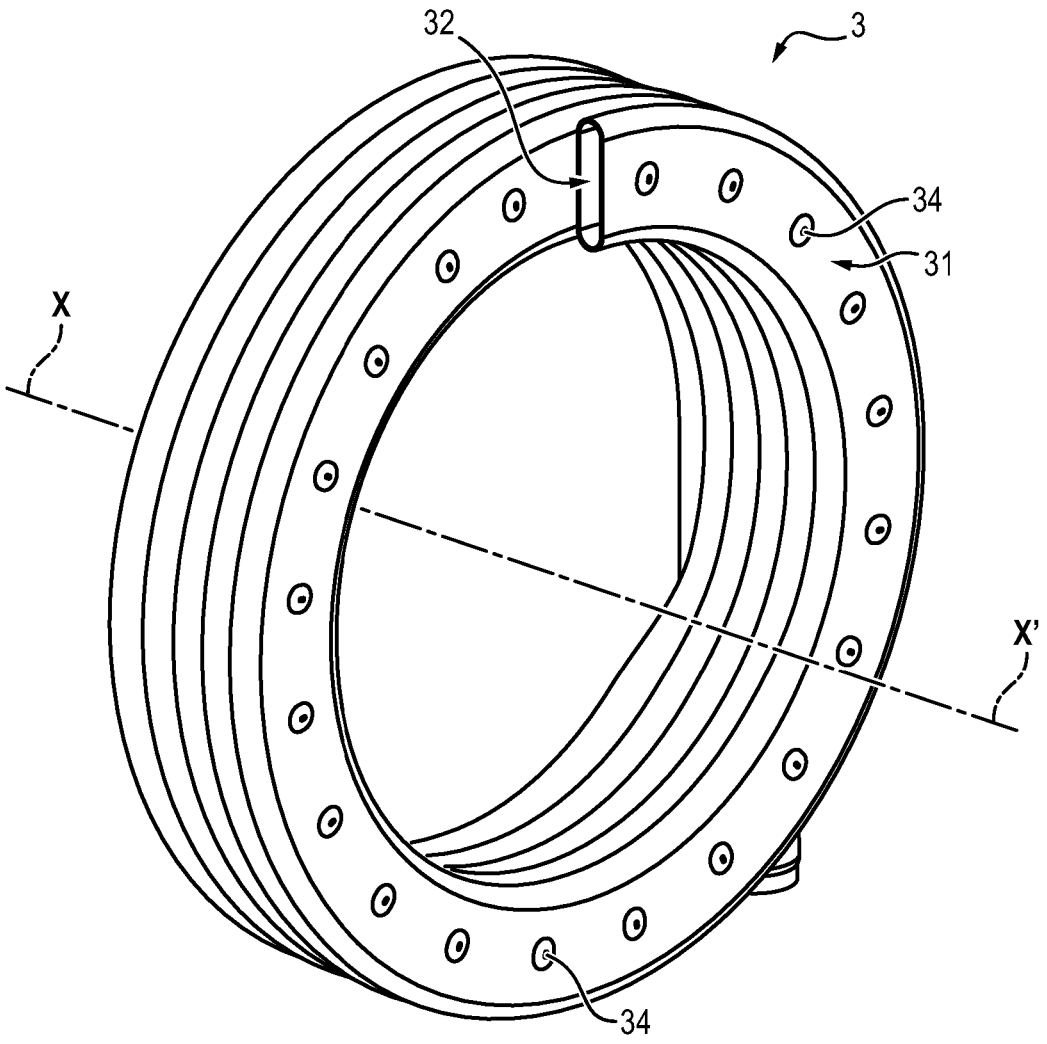
FIG. 2 is a perspective view of a part of the heat exchanger tube of FIG. 1.

The heat exchanger in accordance with the invention, referenced 10, will now be described in more detail with reference to FIG. 3. The elements common with the exchanger 1 of the state of the art, which have been described previously in relation to FIGS. 1 and 2, bear the same numerical references and will not be described again in detail.

The heat exchanger 10 differs from the previous one by the structure of the tube in the vicinity of the deflector and by the structure of this deflector. In this exchanger 10, the tube bears the reference 7 and the deflector bears the reference 8.

Figure 3:
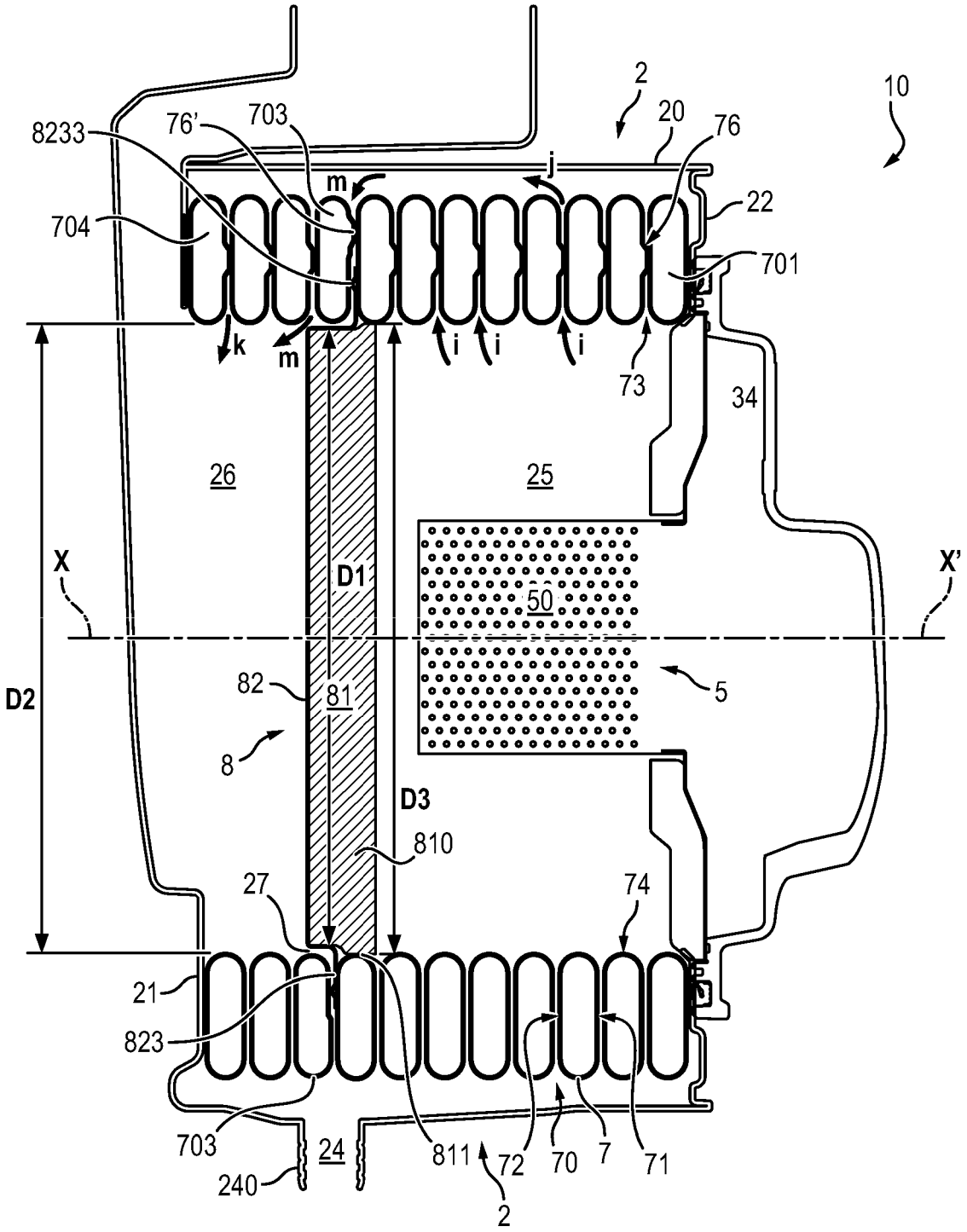
FIG. 3 is a longitudinal sectional view of a first embodiment of a condensation heat exchanger, in accordance with the invention.
Figure 4:
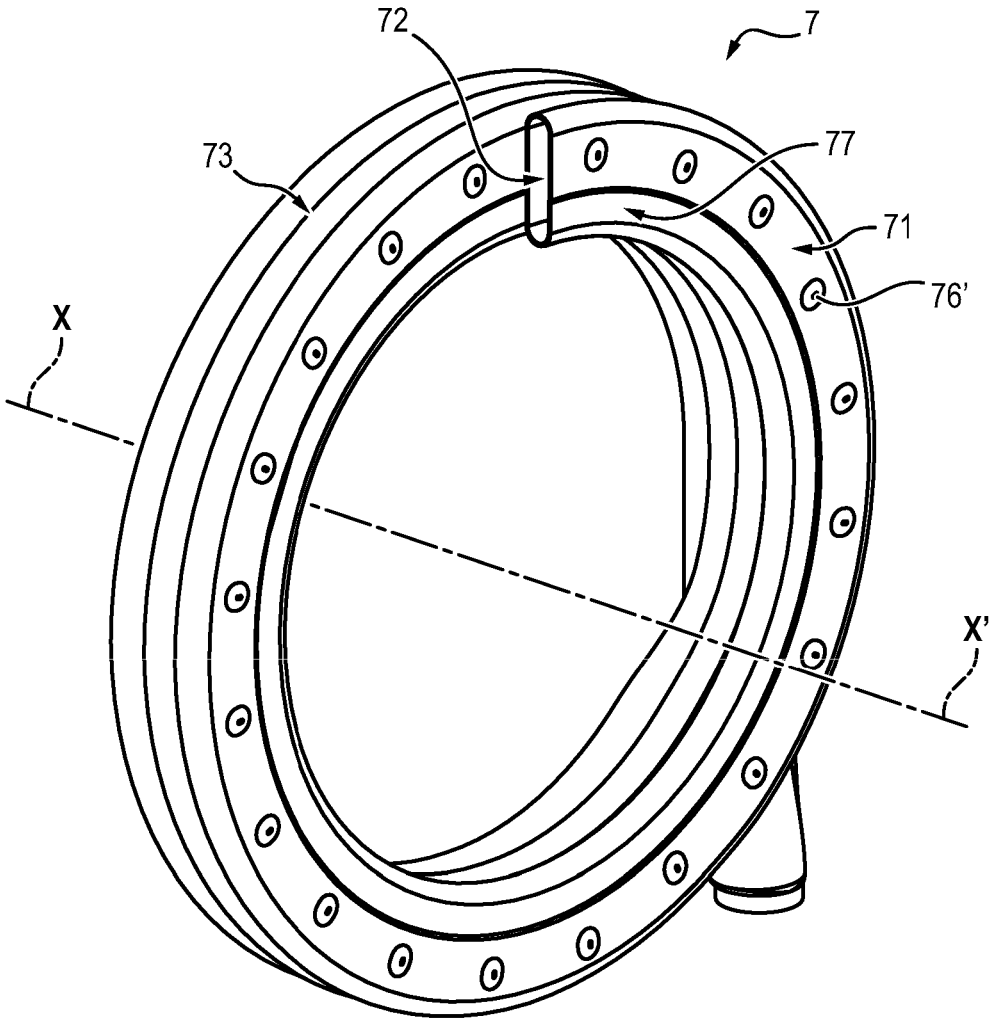
FIG. 4 is a perspective view of a part of the tube of the exchanger, located in the condensation chamber of the heat exchanger in accordance with the invention.

As represented in FIG. 3, the heat exchanger 10 can comprise a single tube 7, helically wound about the axis X-X', so as to form a helical winding 70. It has two ends forming an inlet mouth and an outlet mouth not visible in the figures. It is made of a thermally good conductive material, in particular made of metal, advantageously stainless steel. The fluid to be heated circulates therein.

The tube 7 has a straight, preferably oblong, section (for example of oval shape or oval shape with the two longitudinal sides flattened or a rectangular straight section), so as to have two opposite lateral faces which are therefore planar or substantially planar, respectively a front face 71 and a rear face 72, these faces being perpendicular or approximately perpendicular to the axis X-X' of the winding 70.

The different turns of the tube 7 are spaced apart from each other by an interstice 73, of calibrated width L.

The intrados end of each turn of the helical winding 70 (that is to say the end located inwardly of the winding) is referenced 74 and has the shape of a rectilinear arc of a circle. The same goes for the opposite extrados end, referenced 75.

The interstice 73 is calibrated using a spacer element.

Advantageously, the interstice 73 can be calibrated using bosses 76 (or corrugations), formed on one of the flat faces of the tube 7, (for example here the front face 71), in the wall of this tube 7. These bosses 76 are disposed substantially radially relative to the axis X-X'. They are identical to the bosses 34 of the tube 3. Each boss 76 bears against the face (not provided with bosses) of the adjacent turn. These bosses have a well-determined height and make it possible to accurately calibrate the width of the interstice 73.

Figure 10:
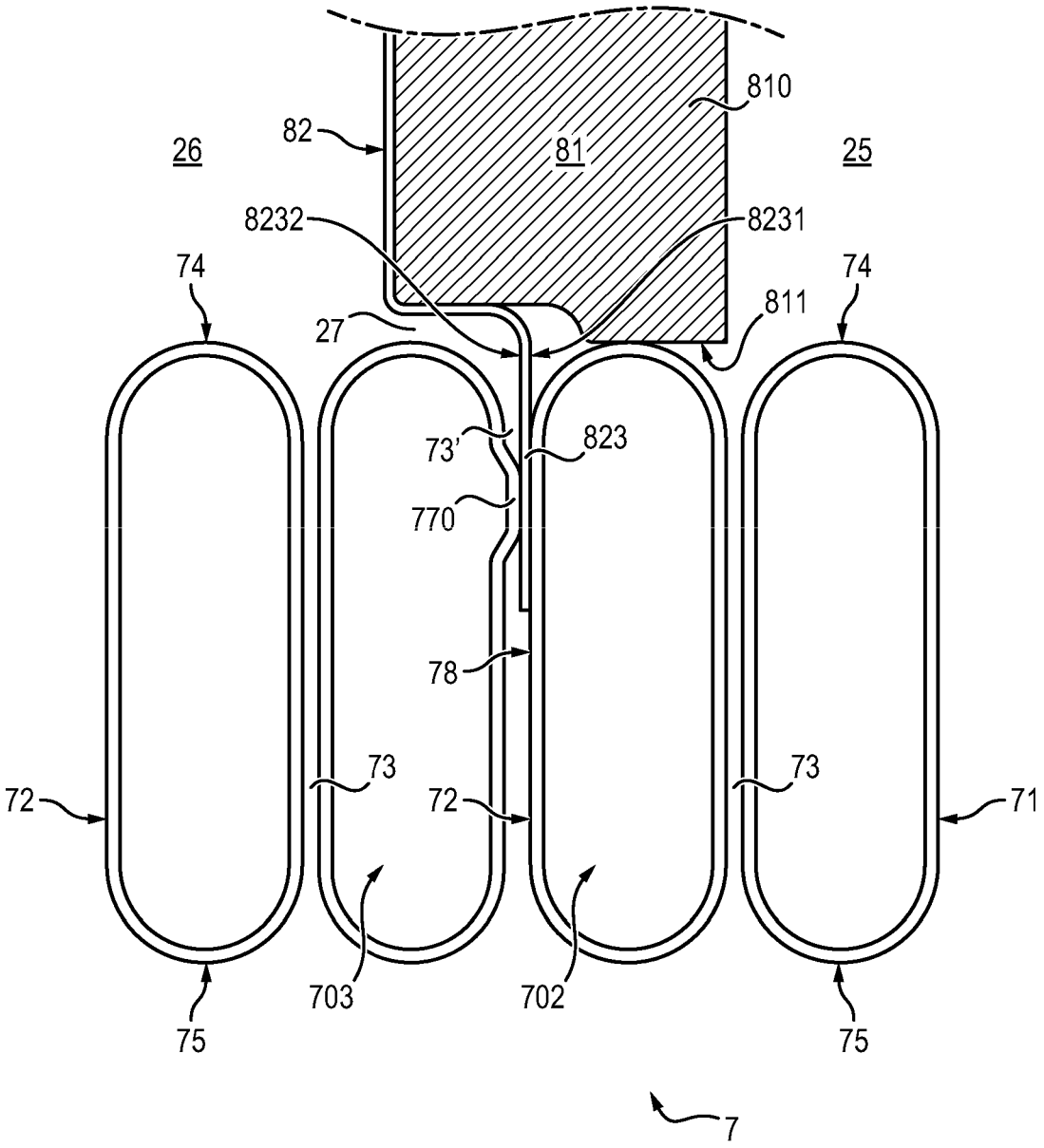
FIG. 10 is a detailed view, similar to FIG. 7, but representing a fourth embodiment of a condensation heat exchanger in accordance with the invention.
Figure 11:
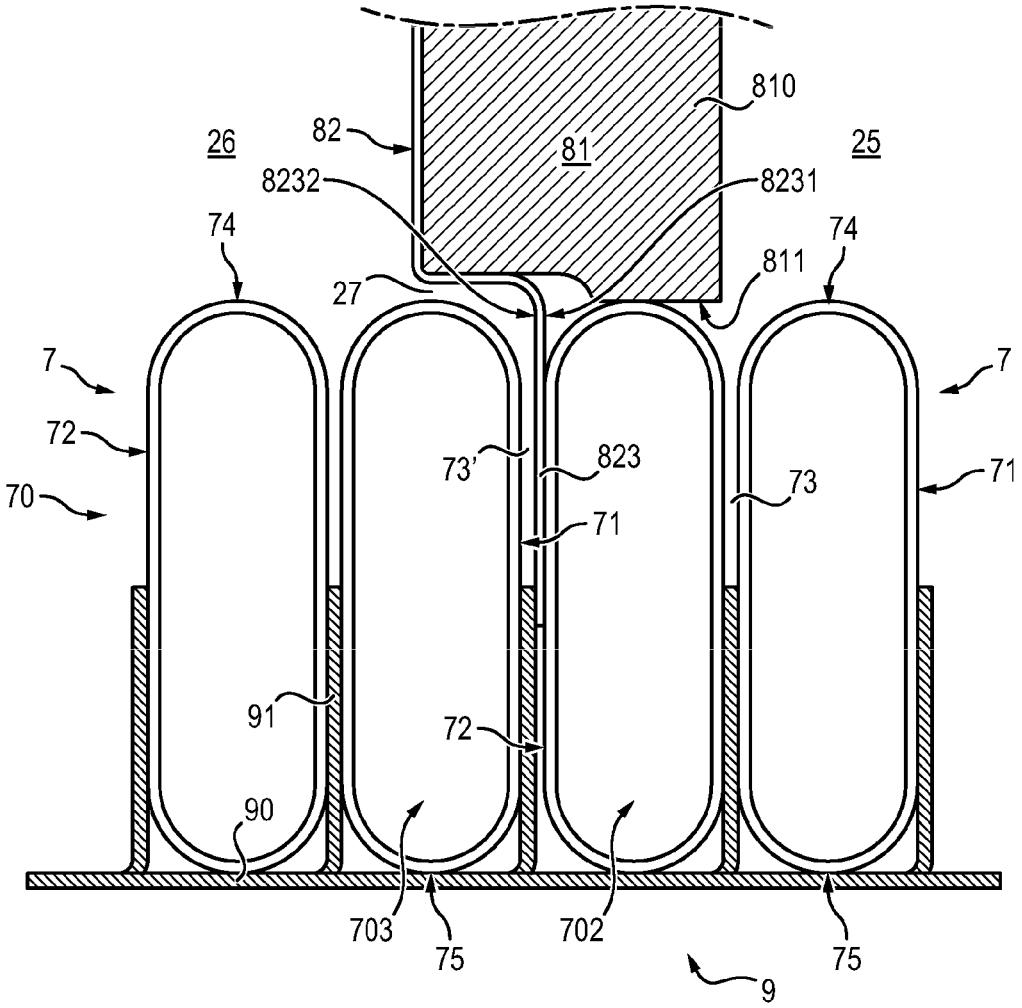
FIG. 11 is a detailed view, similar to FIG. 7, but representing a fifth embodiment of a condensation heat exchanger in accordance with the invention.

The interstice 73 can also be formed with a comb 9, such as the one represented in FIGS. 10 and 11. Such a comb has a central bar 90 and perpendicular tabs 91 (teeth of the comb). This comb 9 is disposed relative to the winding 70 so that each tooth 91 is inserted between two successive turns of the winding 70. Preferably, at least two combs 9 disposed on either side of the winding 70 are used.

The first turn and the last turn of the part of the helical winding 70 located in the combustion chamber 25 bear the numerical references 701 and 702 respectively, while the first turn and the last turn of the part of the winding 70 located in the condensation chamber 26 bear the numerical references 703 and 704 respectively (see FIG. 3).

The deflector 8 comprises a disk 81 made of thermally insulating material, carried by a thin sheet metal frame 82. As can be seen better in FIGS. 5 and 6, the frame 82 has a circular bottom 820 bordered by an annular rim 821, perpendicular to the bottom. The bottom 820 and the rim 821 together delimit a discoid cavity 822, dimensioned to receive and hold the disk 81.

Figure 5:
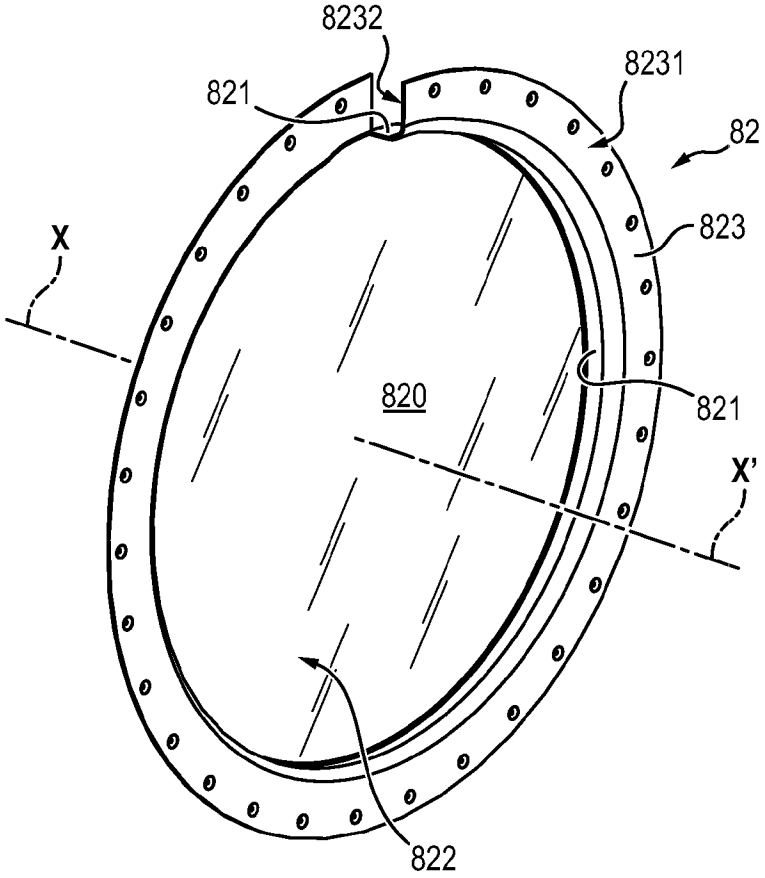
FIG. 5 is a perspective view of a first embodiment of the deflector, intended to be positioned in the heat exchanger in accordance with the invention.
Figure 7:
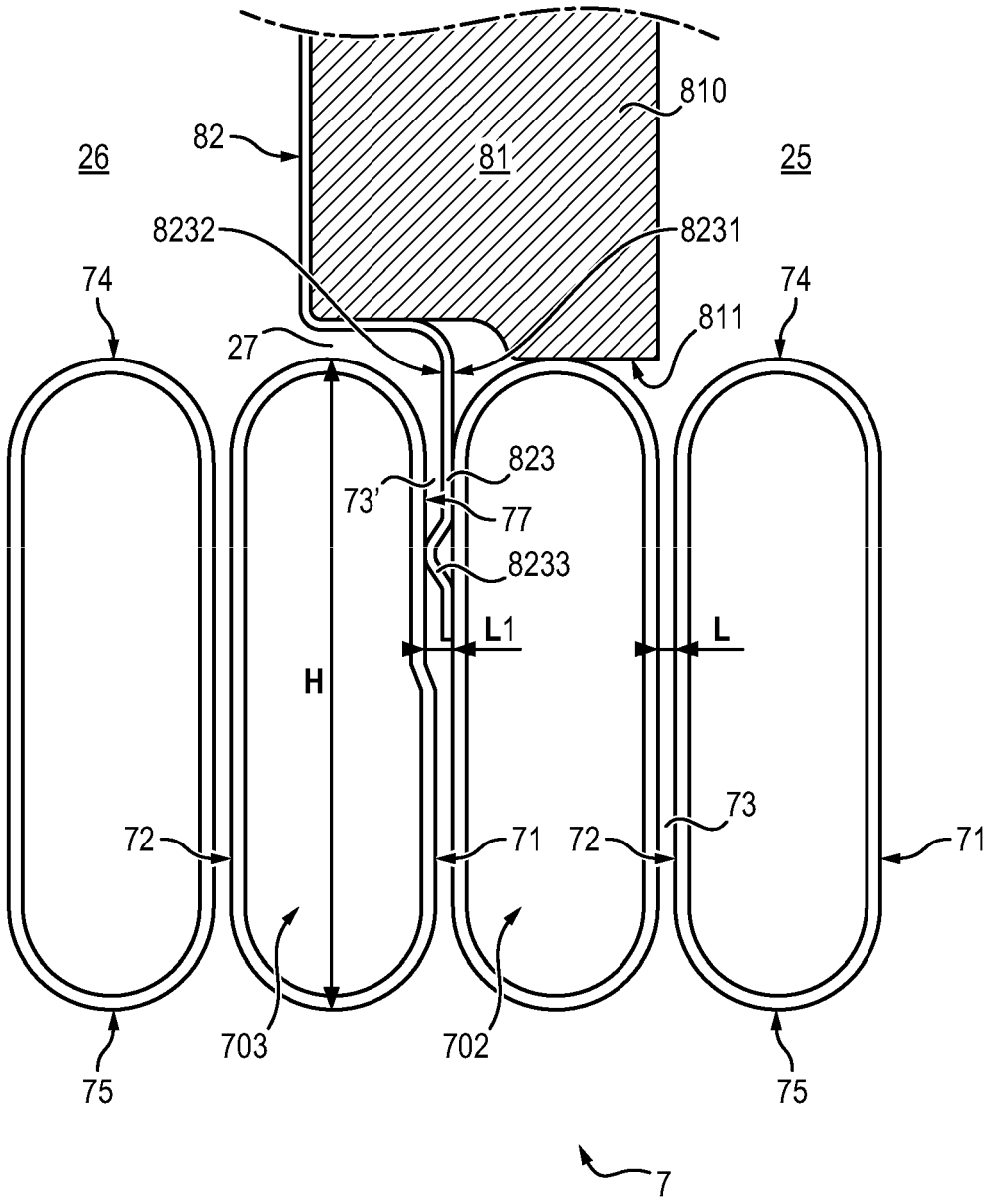
FIG. 7 is a detailed view of the lower part of the condensation heat exchanger of FIG. 3 showing a part of a deflector, the last two turns of the tube being located in the combustion chamber and the first two turns of the tube being located in the condensation chamber.

In the case where the heat exchanger 10 comprises a single helically wound tube 7, the frame 82 is shaped as represented in FIG. 5 and has a flange 823, which extends substantially radially outwards from the rim annular 821 and this flange 823 is helical. This flange 823 can thus be inserted between two successive helical turns of the same tube.

The exchanger 10 can also comprise several tubes 7 each helically wound about the axis X-X', and disposed side by side so that their axes are coaxial. Thus, for example, it is possible to have a first tube winding, disposed in the condensation chamber 26, and inside which a first fluid to be heated circulates and to have a second tube winding in the combustion chamber 25, inside which the same first fluid, or possibly a second fluid to be heated, circulates.

Figure 6:
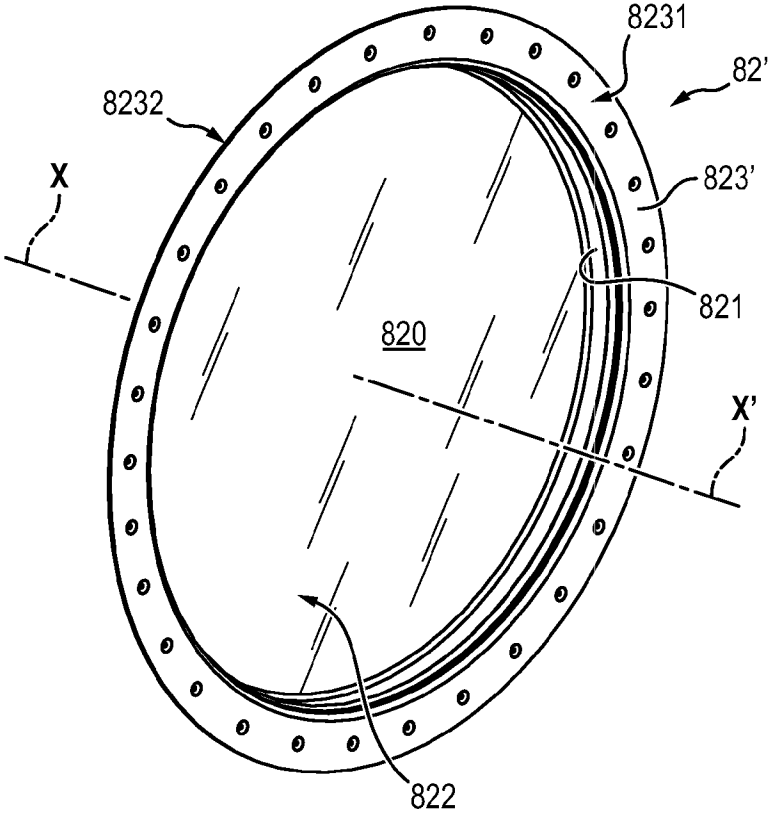
FIG. 6 is a perspective view of a second embodiment of the deflector, intended to be positioned in the heat exchanger in accordance with the invention.

In the case where the heat exchanger 10 comprises at least two helically wound tubes 7, disposed side by side, the frame of the deflector is slightly different from the previous one. It bears the reference 82' and is represented in FIG. 6. It has a flange 823', which is annular, and which extends radially outwards from the annular rim 821. This rim 821 then has a constant height. The flange 823' is perpendicular to the axis X-X'.

Different embodiments of the invention making it possible to position the deflector 8 on the tube 7, while providing a space, for the passage of gases, between this deflector and the first turn of the tube 7 located in the condensation chamber 26, will now be described.

These different embodiments only described, for simplification purposes, the case where the heat exchanger 10 comprises a single winding 70 and where the deflector 8 comprises a frame 82, as represented in FIG. 5. However, all these embodiments could also be implemented with at least two different windings, one mounted in the combustion chamber 25 and the other mounted in the condensation chamber 26, on either side of a deflector 8 which then comprises a frame 82', as represented in FIG. 6.

A first embodiment of the flange of the deflector 8 and of the tube 7 will now be described in more detail with reference to FIGS. 3 to 5 and 7.

The front face 71 of the first turn 703 has an annular shoulder 77. This shoulder is annular in that it extends around the first turn 703 (see FIG. 4).

This annular shoulder 77 extends from the intrados end 74, preferably between a third and half of the height H of said first turn 703. The width L1 between the rear face 72 of the last turn 702 and the front face 71 of the first turn 703, taken at the level of the shoulder 77, is therefore greater than the width L of an interstice 73.

Due to the presence of this shoulder 77, the bosses provided on the front face 71 of the first turn 703 are slightly offset towards the extrados of the turn, where there is no shoulder 77, and bear the reference 76'. Due to the cutting plane, these bosses 76' are not visible in FIG. 7 but are visible in FIGS. 3 and 4. The bosses 76' are bearing against the rear face 72 of the last turn 702.

The tube 7 is advantageously obtained by hydroforming, which allows making and accurately positioning the shoulder 77 and the bosses 76, 76'.

The flange 823 of the frame 82 has a front face 8231, turned towards the facade 22 and an opposite rear face 8232. The rear face 8232 has at least one protruding element 8233, for example in the shape of a pin, preferably several pins. These pins are advantageously obtained by stamping of the front face 8231. They are distributed, preferably uniformly, over the entire periphery of the flange 823 and play the role of a spacer.

The deflector 8 is mounted inside the winding 70, so that the flange 823 is inserted between the rear face 72 of the last turn 702 and the shoulder 77 of the first turn 703 and so that the protruding element(s) 8233 is (are) bearing against this shoulder 77 and thus provide an interstice 73', called "gas circulation" interstice, between the shoulder 77 and the rear face 72 of the last turn 702. Furthermore, the insertion of the flange 823 is made so that its front face 8231 is positioned (pressed), in a gas-tight manner, against the planar rear face 72 of the last turn 702. The flange 823 is thus pinched between the two successive turns 702 and 703. The hot gases radially circulate in this interstice 73' from the outside to the inside of the winding 70 (see arrow m in FIG. 3).

In addition, the external diameter D1 of the deflector 8, more specifically here the external diameter of the discoid cavity 822 of the frame 82, taken at the level of the external face of the rim 821 is smaller than the internal diameter D2 of the helical winding 70, measured at the intrados ends 74 of the turns, so as to provide an axial annular passage, called "gas circulation passage" 27, between the rim 821 and the intrados end of the first turn 703. The hot gases axially circulate in this passage 27 from front to back (see arrow n in FIG. 3).

This gas circulation passage 27 puts the gas circulation interstice 73' in communication with the condensation chamber 26. Thus, and contrary to what was the case in the state of the art, the hot gases can circulate between the last turn 702 and the first turn 703, thus increasing the heat exchanges with the fluid to be heated (for example water) which circulates inside the tube 7.

Advantageously, the disk 81 made of thermally insulating material is thicker than the annular rim 821, so that it has a protruding end 810 which protrudes in the direction of the combustion chamber 25 (see FIG. 3). Advantageously, this protruding end 810 has a diameter D3, which is equal to the internal diameter D2 of the helical winding 70, so that the lateral edge 811 of this end 810 comes into contact with the intrados end 74 of the last turn 702, thus preventing the passage of hot gases at this location.

Moreover, it will be noted that the shoulder 77, which is disposed facing the flange 823, makes it possible to obtain a constant rolling space with the last turn 702, not reduced by the thickness of the sheet metal of the flange 823.

Figure 8:
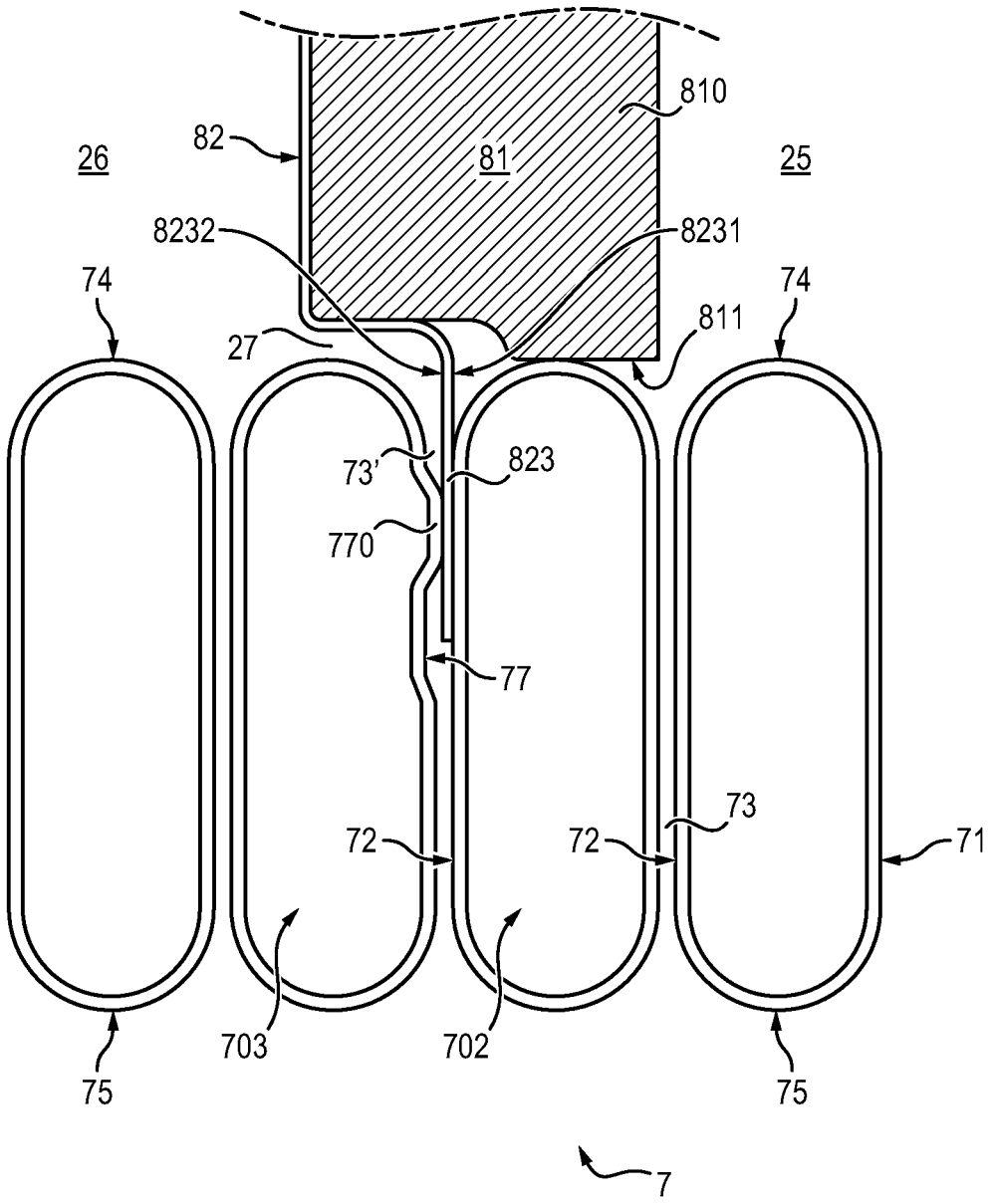
FIG. 8 is a detailed view, similar to FIG. 7, but representing a second embodiment of a condensation heat exchanger in accordance with the invention.

A second embodiment of the flange of the deflector 8 and of the tube 7 will now be described in more detail with reference to FIG. 8.

This embodiment differs from the first one in that the flange 823 does not have any protruding elements and in that the first turn 703 on the other hand has at least one protruding element 770 (spacer), preferably several ones, formed on the annular shoulder 77. These protruding elements 770 are preferably radially and evenly disposed on the shoulder 77. As above, the front face 8231 of the flange 823 is positioned (pressed) in a gas-tight manner against the planar rear face 72 of the last turn 702. Moreover, the protruding elements 770 (which are preferably bosses) abut against the rear face 8232 of the flange 823, which makes it possible to provide the gas circulation interstice 73'.

A third embodiment of the flange 823 of the deflector 8 and of the tube 7 will now be described with reference to FIG. 9. It simply differs from the first embodiment described in relation to FIG. 7, in that the rear face 72 of the last turn 702 on the combustion chamber side has an annular shoulder 78. Preferably, this annular shoulder 78 extends from the intrados end 74 between a third and half of the height H of the last turn 702. The front face 8231 of the flange 823 is positioned in a gas-tight manner against this annular shoulder 78 and the height of the protruding element 8233 is adapted accordingly to be in contact with the shoulder 77.

A fourth embodiment of the flange of the deflector 8 and of the tube 7 will now be described with reference to FIG. 10.

Figure 9:
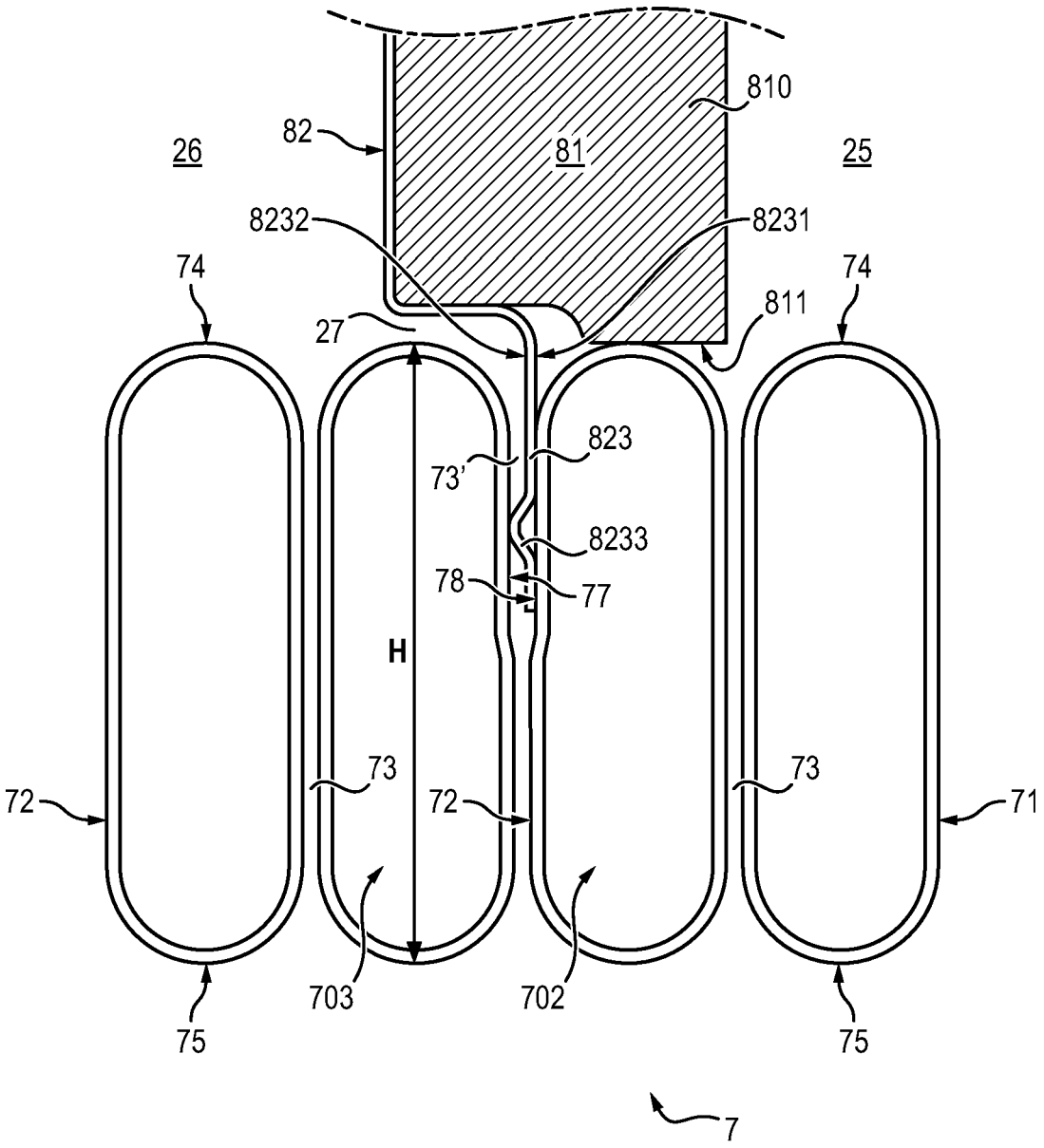
FIG. 9 is a detailed view, similar to FIG. 7, but representing a third embodiment of a condensation heat exchanger in accordance with the invention.

It differs from the third embodiment of FIG. 9, in that the flange 823 does not comprise a protruding element 8233, in that the first turn 703 does not comprise a shoulder 77 but on the other hand comprises a protruding element 770.

It is easy to understand that the different embodiments can be combined by providing the shoulder 77 and/or the shoulder 78 and the different spacer elements 8233 and/or 770, as long as the circulation space 73' is provided.

Figure 12:
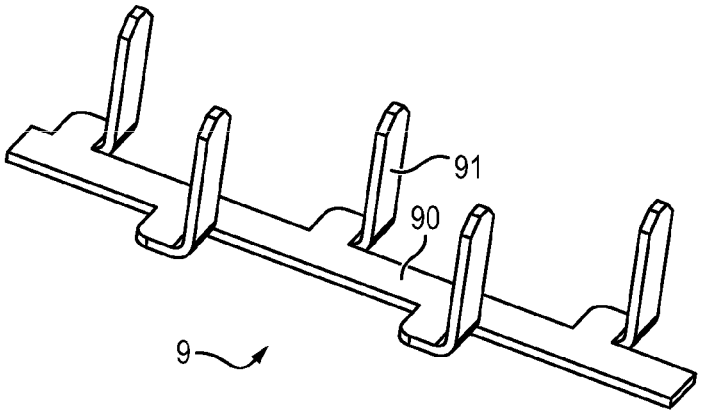
FIG. 12 is a perspective view of a spacer element.

Finally, a fifth embodiment will now be described with reference to FIGS. 11 and 12. The aforementioned comb 9 is also used to form the gas circulation interstice 73'. In this case, one of its teeth 91 is interposed (pinched) between the rear face 8232 of the flange 823 and the front face 71 of the first turn 703, on the condensation chamber side 26, while the flange 823 rests in a gas-tight manner against the rear face 72 of the last turn 702.

The invention claimed is:

1. A condensation heat exchanger comprising:

at least one tube, helically wound so as to form a helical winding with adjacent turns and inside which a fluid to be heated circulates, the tube being made of a thermally good conductive material and having a planar or substantially planar front face and a planar or substantially planar rear face opposite to each other and perpendicular or approximately perpendicular to an axis of the helical winding, the helical winding being arranged so as to provide an interstice between the adjacent turns, each turn of the helical winding having an intrados end, a gas-tight casing inside which the at least one tube is mounted, the casing comprising a bottom and a facade on which a door is mounted, the casing being provided with a sleeve for discharging burnt gases, the front face of the tube being turned towards the facade of the casing and the rear face of the tube being turned towards the bottom of the casing, means for supplying and/or producing a hot gas inside the casing, mounted on the door, a discoid deflector being disposed inside the helical winding of the tube, so as to provide inside the casing, a combustion chamber between the door and the discoid deflector, and a condensation chamber between the discoid deflector and the bottom of the casing, the deflector comprising a disk made of thermally insulating material, carried by a sheet metal frame provided with a peripheral flange, the peripheral flange being interposed in an interstice between two successive turns of the helical winding, the peripheral flange having a front face turned towards the facade of the casing and a rear face turned towards the bottom of the casing, opposite to each other, and an external diameter of the discoid deflector being smaller than an internal diameter of the helical winding taken at the intrados ends of the turns, so as to provide, between an edge of the discoid deflector and the intrados end of a first turn of the helical winding located in the condensation chamber, a hot gas circulation passage, wherein the front face of the peripheral flange being positioned in a gas-tight manner against the rear face of a last turn of the helical winding located in the combustion chamber, to entirely block a radial gas passage outwardly from the combustion chamber between the front face of the peripheral flange and the rear face of the last turn of the helical winding, wherein at least one spacer element is disposed between the rear face of the peripheral flange and the front face of the first turn of the helical winding located in the condensation chamber, so as to provide therebetween a gas circulation interstice, so that the hot gases radially or approximately radially pass through the gas circulation interstice, from outside to inside of the helical winding, then axially pass through the hot gas circulation passage from front to back of the condensation heat exchanger, in the direction of the condensation chamber.

2. The heat exchanger according to claim 1, wherein the front face of the first turn of the helical winding located in the condensation chamber is provided with an annular shoulder which extends from the intrados end of the first turn and wherein the at least one spacer element extends between the annular shoulder and the rear face of the peripheral flange, so as to form the gas circulation interstice.

3. The heat exchanger according to claim 1, wherein the rear face of the last turn of the helical winding located in the combustion chamber is provided with an annular shoulder which extends from the intrados end of the last turn of the helical winding located in the combustion chamber, wherein the front face of the peripheral flange is disposed in a gas-tight manner against the annular shoulder of the rear face.

4. The heat exchanger according to claim 1, wherein the spacer element consists of a protruding element, formed on the rear face of the peripheral flange, the protruding element bearing against the front face of the first turn of the helical winding located in the condensation chamber, or against the annular shoulder of the front face, so as to provide the gas circulation interstice.

5. The heat exchanger according to claim 1, wherein the spacer element consists of a protruding element, formed in a wall of the tube, the protruding element formed in the wall of the tube protruding from the front face of the first turn of the helical winding located in the condensation chamber or from the annular shoulder of the front face and wherein the protruding element formed in the wall of the tube is bearing against the rear face of the peripheral flange, so as to provide the gas circulation interstice.

6. The heat exchanger according to claim 1, wherein the spacer element consists of a comb having a tooth interposed between the front face of the first turn of the helical winding located in the condensation chamber and the rear face of the peripheral flange, so as to provide the gas circulation interstice.

7. The heat exchanger according to claim 1, wherein the sheet metal frame of the discoid deflector has a circular bottom bordered by an annular rim perpendicular to the circular bottom, so as to provide a discoid cavity for receiving the disk made of thermally insulating material and wherein the peripheral flange protrudes outwards from the annular rim.

8. The heat exchanger according to claim 7, wherein the disk made of thermally insulating material has a protruding end which protrudes from the discoid cavity inwardly of the combustion chamber and wherein a diameter of the protruding end is equal to an internal diameter of the helical winding of the tube, taken at the intrados ends of the turns of the tube, so that a lateral edge of the protruding end is in gas-tight contact with the intrados end of the last turn of the tube located in the combustion chamber, thus preventing the passage of hot gases between the two.

9. The heat exchanger according to claim 1, wherein the heat exchanger comprises a single tube forming the helical winding and wherein the peripheral flange of the sheet metal frame of the deflector is helical.

10. The heat exchanger according to claim 1, wherein the heat exchanger comprises at least two tubes helically wound to form at least two adjacent helical windings, one being disposed in the combustion chamber and the other being disposed in the condensation chamber and wherein the peripheral flange of the sheet metal frame of the deflector, disposed between the two adjacent windings, is annular and perpendicular to an axis of the two adjacent helical windings.

11. The heat exchanger according to claim 1, wherein the fluid to be heated is water.

12. The heat exchanger according to claim 1, wherein the means for supplying and/or producing a hot gas inside the casing is a gas or oil burner mounted on the door.

13. The heat exchanger according to claim 2, wherein the spacer element consists of a protruding element, formed on the rear face of the peripheral flange, the protruding element bearing against the front face of the first turn of the helical winding located in the condensation chamber, or against the annular shoulder of the front face, so as to provide the gas circulation interstice.

14. The heat exchanger according to claim 2, wherein the spacer element consists of a protruding element, formed in a wall of the tube, the protruding element formed in the wall of the tube protruding from the front face of the first turn of the helical winding located in the condensation chamber or from the annular shoulder of the front face and wherein the protruding element formed in the wall of the tube is bearing against the rear face of the peripheral flange, so as to provide the gas circulation interstice.

15. The heat exchanger according to claim 4, wherein the protruding element formed on the rear face of the peripheral flange of the sheet metal frame is a stamping.

16. The heat exchanger according to claim 5, wherein the protruding element formed in a wall of the tube is a boss.

* * * * *